US008149077B2

(12) United States Patent
Yano et al.

(10) Patent No.: US 8,149,077 B2
(45) Date of Patent: Apr. 3, 2012

(54) ELECTROMAGNETIC OPERATING DEVICE FOR SWITCH

(75) Inventors: Tomotaka Yano, Chiyoda-ku (JP); Masahiro Arioka, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 277 days.

(21) Appl. No.: 12/295,720

(22) PCT Filed: Apr. 10, 2006

(86) PCT No.: PCT/JP2006/307558

§ 371 (c)(1), (2), (4) Date: Oct. 1, 2008

(87) PCT Pub. No.: WO2007/116516

PCT Pub. Date: Oct. 18, 2007

(65) Prior Publication Data

US 2009/0160588 A1 Jun. 25, 2009

(51) Int. Cl.
*H01F 3/00* (2006.01)
*H01F 7/08* (2006.01)

(52) U.S. Cl. ..... 335/281; 335/279; 335/297

(58) Field of Classification Search ..... 335/279, 335/281, 297; 336/210

See application file for complete search history.

(56) References Cited

U.S. PATENT DOCUMENTS 1,710,761 A * 4/1929 Andersen ..... 335/245
2,094,199 A * 9/1937 Werner ..... 337/3
6,118,366 A * 9/2000 Bulgatz et al. ..... 336/234
2001/0017288 A1 8/2001 Morita et al.
2004/0201943 A1 10/2004 Takeuchi et al.

FOREIGN PATENT DOCUMENTS

EP 0 923 089 A1 6/1999
EP 1 416 503 A2 5/2004
JP 61-198604 A 9/1986
JP 62-268330 A 11/1987

(Continued)

OTHER PUBLICATIONS

Form PCT/ISA/210 (International Search Report) dated May 16, 2006.

(Continued)

*Primary Examiner* — Ramon Barrera
(74) *Attorney, Agent, or Firm* — Buchanan Ingersoll & Rooney PC

(57) ABSTRACT

An electromagnetic operating device for a switch comprises a fixed yoke (1) formed by laminating square yokes and an E-shaped yoke integrally while holding the E-shaped yoke in-between, a permanent magnet (5), a moving member (2) capable of linear movement in the fixed yoke by a predetermined distance, a rod (3) coupled with the moving member and penetrating the fixed yoke to project outward from opposite sides, and a drive coil (4) disposed in the fixed yoke, the moving member moving on the inside of the fixed yoke when a current is supplied through the drive coils, wherein the fixed yoke (1) is provided with a plurality of holes (1*c*) penetrating in the laminating direction of magnetic steel sheets, pins (6) each having a diameter slightly smaller than that of the plurality of holes and provided with a threaded portion (6*a*) at the end are inserted to penetrate two or more of the plurality of holes, and the laminated fixed yoke is fastened using the threaded portions of the pins.

10 Claims, 6 Drawing Sheets

FOREIGN PATENT DOCUMENTS

| | | | |
|---|---|---|---|
| JP | 2001-237118 | A | 8/2001 |
| JP | 2004-165075 | A | 6/2004 |
| JP | 2004-247093 | A | 9/2004 |
| JP | 2004-288502 | A | 10/2004 |
| WO | WO 00/33329 | A1 | 6/2000 |

OTHER PUBLICATIONS

Supplementary European Search Report and European Search Opinion dated Nov. 15, 2010, issued by the European Patent Office in corresponding European patent application.

* cited by examiner (c)

(c)

ELECTROMAGNETIC OPERATING DEVICE FOR SWITCH

TECHNICAL FIELD

The present invention relates to an electromagnetic operating device for a switch that drives switches used in facilities for transmission distribution, reception and the like of electric power.

BACKGROUND ART

FIG. 5 is a cross-sectional view showing an example of a conventional electromagnetic operating device for a switch disclosed in Japanese Laid-Open Patent Publication No. 2004-165075, which is roughly configured as follows:

In FIG. 5, the electromagnetic operating device includes a fixed core unit 10, a moving core unit 40, drive coils 20 and 30, and permanent magnets 50. The fixed core unit 10 includes a first core 11 to a forth core 14; the first core 11 includes a ring-shaped core section 11*a* and engaging sections 11*e*; the engaging sections 11*e* are formed between the ring-shaped core section and projecting sections 11*f* that project in X directions from sections that face each other in the X directions in the X-Y-Z triaxial coordinate system of the ring-shaped core section 11*a*. The second core 12 has the same frame as that of the first core.

The third core 13 and the fourth core 14 have their own split core sections. The first core 11 and the second core 12 are arranged in such a way that their ring-shaped core sections face each other maintaining there between a predetermined gap in a Y direction; the third core 14 and the fourth core 15 are arranged facing each other in the X directions so as to form a combined core unit of each of the split core sections; and the combined core unit is disposed in the gap between the first core 11 and the second core 12 that face each other so that, viewed from Y directions, the combined core unit and the ring-shaped core sections of the first core 11 and the second core 12 overlap with each other.

A container section 10*b* is formed being enclosed by the ring-shaped core sections of the first core 11 and the second core 12 and a ring-shaped core section formed of the split core sections of the third core 13 and the fourth core 14.

The moving core unit 40 includes a moving core 41 formed into a rectangular block by laminating magnetic steel sheets and support shafts 45 and 46 that are fixed to the moving core 41 and made of a non-magnetic material. The permanent magnets 50 each are formed into a thick rectangular plate, for example, and magnetically attached onto the top and bottom faces of the moving core 41 and pressed thereonto with a support member 60 that covers outer faces of the permanent magnets 50.

Moreover, coils 20 and 30 are wound around bobbins 21 and 31, respectively, and the bobbins 21 and 31 are engaged in the engaging sections 11*e* of the first core 11, and their positions are thereby restricted in X and Z directions.

The moving core 41 is held in the container section 10*b* and supported by the support shafts 45 and 46 that are supported by bearings 80 provided in the fixed core unit, so that the moving core unit 40 is enabled to move in Z directions by energizing the coils 20 and 30.

Patent Document 1: Japanese Laid-Open Patent Publication No. 2004-165075 (FIG. 1-FIG. 7)

DISCLOSURE OF THE INVENTION

Problem to be Solved by the Invention

However, in a conventional electromagnetic operating device for a switch as described above, the fixed yoke (fixed core unit 10) is configured such that bolts 19 are inserted into through-holes provided at a plurality of locations on laminated magnetic steel sheets as penetrating therethrough, so that the yoke is fastened with nuts. Because the diameter of the bolts 19 is considerably smaller than that of the through-holes, when the moving member (moving core 41) moves to collide with an inner face of the fixed yoke formed of laminated magnetic steel sheets, if there are irregularities in each laminated magnetic steel sheet of the fixed yoke that abuts the moving member, collision force Fm of the moving member is spread over each magnetic steel sheet; in particular, magnetic steel sheets that project toward the moving member undergo large collision force Fm1. If this collision force Fm1 becomes larger than friction force k·Fb1 determined by surface pressure Fb1 that is applied to between each laminated sheet by fastening force Fb by the fastening bolts and a friction coefficient k between the same, misalignment occurs between the laminated steel sheets, and magnetic resistance at a portion where the moving member abuts the fixed yoke varies due to variations in the gap between the moving member and the fixed yoke (magnetic gap), thereby causing a problem in that holding force that attracts the moving member toward the inner face of the fixed yoke varies.

The present invention aims at solving such a problem with a conventional device as described above and providing an electromagnetic operating device for a switch, in which, even if the fixed yoke undergoes collision force when the moving member moves, misalignment would not occur between the laminated magnetic steel sheets, thereby stably holding the magnetic steel sheets, so that the holding force that attracts the moving member toward the inner face of the fixed yoke can be prevented from varying.

Means for Solving the Problem

An electromagnetic operating device for a switch according to the present invention includes a fixed yoke that is formed in such a way that E-shaped yokes formed by laminating E-shaped magnetic steel sheets are arranged opposite each other with their projecting sections of the E-shape facing each other, square yokes that are formed by laminating magnetic steel sheets and have a ring-shaped core section and a projecting magnetic pole section are disposed on both outer sides of the E-shaped yokes, and the square yokes and the E-shaped yokes are integrally laminated with the E-shaped yokes being sandwiched between the square yokes; permanent magnets; a moving member capable of linearly moving a predetermined distance inside the fixed yoke; a rod that is connected to the moving member and penetrates the fixed yoke to project outward from both sides thereof; and coils disposed in the fixed yoke; the moving member is moved by magnetic flux generated by supplying a current to the coils so as to abut the inner periphery of the fixed yoke, and the movement position of the moving member is held by the magnets; wherein the electromagnetic operating device for a switch is configured such that a plurality of holes penetrating magnetic steel sheets in a laminating direction of the sheets is provided in the fixed yoke, and pins whose diameter is slightly smaller than that of the plurality of holes and whose end portions are threaded are inserted into at least two of the plurality of holes to penetrate therethrough, so that the laminated steel sheets of the fixed yoke are fastened using the threaded portions of the pins.

An electromagnetic operating device for a switch of the present invention includes a fixed yoke that is formed in such a way that E-shaped yokes formed by laminating E-shaped magnetic steel sheets are arranged opposite each other with their projecting sections of the E-shape facing each other, square yokes that are formed by laminating magnetic steel sheets and have a ring-shaped core section and a projecting magnetic pole section are disposed on both outer sides of the E-shaped yokes, and the square yokes and the E-shaped yokes are integrally laminated with the E-shaped yokes being sandwiched between the square yokes; permanent magnets; a moving member capable of linearly moving a predetermined distance inside the fixed yoke; a rod that is connected to the moving member and penetrates the fixed yoke to project outward from both sides thereof; and coils that are disposed in the fixed yoke; the moving member is moved by magnetic flux generated by supplying a current to the coils so as to abut the inner periphery of the fixed yoke, and the movement position of the moving member is held by the magnets; wherein the electromagnetic operating device for a switch is configured such that a plurality of holes penetrating magnetic steel sheets in a laminating direction of the sheets is provided in the fixed yoke, pins that are slightly larger than the plurality of holes and have a diametrical elasticity are press-fitted into at least two of the plurality of holes to penetrate therethrough, and volts are inserted into the other holes, so that the laminated steel sheets of the fixed yoke are fastened using nuts.

Advantage of the Invention

According to an electromagnetic operating device for a switch of the present invention, even if the fixed yoke undergoes collision force when the moving member moves, the collision force of the moving member is spread by the pins over each of the laminated steel sheets, and magnetic steel sheets are always held with each other by the pins; therefore, misalignment would not occur between the laminated magnetic steel sheets, and the magnetic steel sheets thereby can be stably held. As a result, holding force that attracts the moving member toward the inner face of the fixed iron yoke can be prevented from varying with a low cost configuration.

BEST MODE FOR CARRYING OUT THE INVENTION

Embodiment 1

FIG. 1 to FIG. 3 show Embodiment 1 of the present invention; FIG. 1(*a*) is a conceptual view showing a configuration of an electromagnetic operating device for a switch, and FIG. 1(*b*) is a schematic cross-sectional view viewed from the right side direction of FIG. 1(*a*). FIG. 2 is a plan view and a side view of a square yoke; FIG. 3, a plan view and a side view of an E-shaped yoke.

In FIG. 1 to FIG. 3, a fixed yoke 1 includes E-shaped yokes 1*a* (refer to FIG. 3) that are made of magnetic steel sheets and face each other, and square yokes 1*b* (refer to FIG. 2) that are made of magnetic steel sheets and disposed on both side of the E-shaped yokes 1*a*. That is, as shown in FIG. 2, the square yokes 1*b* each are formed into a square ring-shaped block by laminating a predetermined number of magnetic steel sheets 1*b*1 that have been fabricated, for example, by punching magnetic steel sheets into a square window-frame shape and include a ring-shaped core section 1*b*2 and projecting magnetic pole sections 1*b*3.

Moreover, E-shaped yokes 1*a* each have a shape such as the square yokes 1*b* shown in FIG. 2 is horizontally split into two approximate halves, and, as shown in FIG. 3, are formed by laminating a predetermined number of magnetic steel sheets 1*a*1 that have been fabricated into an E-shape, for example, by punching magnetic steel sheets such that both end sections 1*a*2 are longer than the central projecting pole section 1*a*3. The E-shaped yokes are arranged opposite each other with the projecting sections of the E-shaped yokes 1*a*, namely end sections 1*a*2 thereof, facing each other, as well as the square yokes 1*b* are disposed on both outer sides of the E-shaped yokes 1*a*, and then the square yokes and the E-shaped yokes are integrally laminated with the E-shaped yokes 1*a* being sandwiched between the square yokes, so that the fixed yoke 1 is formed.

A moving member 2 that linearly moves inside the fixed yoke 1 is disposed in the center of the fixed yoke 1; a rod 3 that penetrates inside the lamination of the fixed yoke 1 and projects outward from both sides thereof is disposed at the center of the moving member 2. Here, the moving member 2 includes laminations 2*a* and 2*b* that are formed by laminating magnetic steel sheets.

Drive coils 4 are provided inside the fixed yoke 1 as encircling the moving member 2; permanent magnets 5 are fixed between the fixed yoke 1 and the moving member 2, in the positions symmetrical with respect to the moving member.

A plurality of holes 1*c* that penetrate magnetic steel sheets in their laminating direction is provided in the E-shaped yokes 1*a* and the square yokes 1*b* of the fixed yoke 1; pins 6 are inserted into at least two of the plurality of holes 1*c* to penetrate therethrough. The outer diameter of the pins 6 is slightly smaller than the inner diameter of the holes 1*c* in the fixed yoke 1; threaded portions 6*a* are provided on both ends of the pins 6, so that the laminated fixed yoke 1 is integrally fastened using the threaded portions 6*a* on both ends. Furthermore, bolts 7 whose thread diameter is smaller than the inner diameter of the holes 1*c* are used in the holes, out of the plurality of holes 1*c*, into which pins 6 are not inserted, so as to fasten the laminated fixed yoke 1.

Meanwhile, a plurality of holes 2*c* that penetrate the sheets in their laminating direction is formed also in the laminated magnetic steel sheets 2*a* and 2*b* of the moving member; pins 8 are inserted into at least two of the plurality of holes 2*c* to penetrate therethrough. The outer diameter of the pins 8 is slightly smaller than the inner diameter of the holes 2*c* in the moving member; threaded portions 8*a* are provided on both ends of the pins; the laminated moving member 2 is fastened using the threaded portions 8*a* on both ends. Moreover, bolts 9 whose thread diameter is smaller than the inner diameter of the holes 2*c* are used in the holes, out of the plurality of holes 2*c*, into which pins 8 are not inserted, so as to fasten the moving member 2.

Moreover, in the pins 6 and 8 that are provided in laminating directions of the fixed yoke 1 and the moving member 2, respectively, the length L of each of sections 6*b* and 8*b* whose outer diameter is slightly smaller than the inner diameter of the through-holes 1*c* and 2*c* that are provided in the fixed yoke 1 and the moving member 2 in their laminating directions, respectively, is made such that the length L is shorter than H and longer than a length in which 2T is subtracted from H, that is, $H-2T<L<H$, with respect to a lamination thickness H determined by the sheet thickness T of laminated magnetic steel sheets of the fixed yoke and the moving member and the number of laminated sheets n; therefore, sections 6*b* and 8*b* do not project from both end surfaces of the laminated fixed yoke 1 and the laminated moving member 2, respectively but are located at positions almost equally recessed from both end surfaces of the laminated fixed yoke 1 and moving member 2.

As described above, the electromagnetic operating device for a switch according to Embodiment 1 of the present invention is configured as follows: a plurality of holes that penetrate magnetic steel sheets in their laminating direction is provided in the fixed yoke or both fixed yoke and the moving member; pins whose diameter is slightly smaller than that of the plurality of holes and both ends of which are threaded are inserted into at least two of the plurality of holes to penetrate therethrough; and laminated magnetic steel sheets of the fixed yoke and the moving member are fastened using the threaded portions on both ends of the pins. Therefore, the following remarkable effects can be brought about.

That is, in a conventional device in which laminated steel sheets are fastened with bolts and nuts, the diameter of the bolts is considerably smaller than that of through-holes, and in addition, pressing threads of the bolts onto the laminated steel sheets with strong force causes the threads to get blunt, thereby further increasing gaps between the through-holes and the bolts. In contrast to the above, in the case of pins in Embodiment 1, even if magnetic steel sheets are pressed onto the pins with the same force as the case using the bolts, the outer periphery of the pins does not get blunt, so that the gaps between the holes in the magnetic steel sheets and the pins remain unchanged. Therefore, when the moving member moves to collide with an inner face of the fixed yoke laminated with magnetic steel sheets, even if magnetic steel sheets that project toward the moving member undergo large collision force Fm1 because of irregularities between each laminated magnetic steel sheet of the fixed yoke that abuts the moving member, collision force Fm of the moving member is spread over each magnetic steel sheet and the magnetic steel sheets are always held with each other by the pins; therefore, misalignment does not occur between laminated magnetic steel sheets, so that the magnetic steel sheets can be stably held. As a result, holding force that attracts the moving member toward the inner face of the fixed yoke can be prevented from varying with a low cost configuration.

Moreover, when the moving member has a lamination structure, there is a fear in that misalignment might occur due to collision force of the moving member with the fixed yoke, between magnetic steel sheets of the moving member as well, causing the holding force to vary. However, by using pins to fasten the magnetic steel sheets of the moving member in the same way as that in the fixed yoke, such fear can be eliminated, as well as variations in the holding force can be curbed.

Furthermore, by bringing the length L of the pins into the relation of $H-2T<L<H$ as described above, the straight-line portion of the pins necessarily interferes with entire or part of sheet pressure of each laminated magnetic steel sheet; therefore, misalignment between magnetic steel sheets can be curbed without fail.

Embodiment 2

FIG. 4 shows Embodiment 2 of the present invention; FIG. 4(*a*) is a conceptual view of a configuration of an electromagnetic operating device for a switch; FIG. 4(*b*), a schematic cross-sectional view viewed from the right side direction of FIG. 4(*a*). In FIG. 4, since configurations of the fixed yoke 1, the moving member 2, the rod 3, drive coils 4, permanent magnets and the like are the same as those in Embodiment 1 described above, their explanations will be omitted.

A plurality of holes 1*c* that penetrate magnetic steel sheets in their laminating direction is provided in the E-shaped yokes 1*a* and the square yokes 1*b* of the fixed yoke 1; pins P1, such as spring-pins, whose diameter is slightly larger the inner diameter of the holes 1*c* in the fixed yoke and that have a diametrical elasticity are press-fitted into at least two of the plurality of holes 1*c* to penetrate therethrough; bolts 7 whose thread diameter is smaller than the inner diameter of the holes 1*c* are used in the holes, out of the plurality of holes 1*c*, into which the pins P1 are not inserted, so as to fasten the laminated fixed yoke 1.

Meanwhile, a plurality of holes 2*c* that penetrate magnetic steel sheets in their laminating direction is provided in the laminated magnetic steel sheets 2*a* and 2*b* of the moving member 2; pins P2, such as spring-pins, whose outer diameter is slightly larger than the inner diameter of the holes 2*c* and that have a diametrical elasticity are press-fitted into at least two of the plurality of holes 2*c* to penetrate therethrough; the bolts 9 whose thread diameter is smaller than the inner diameter of the holes 2*c* are used in the holes, out of the plurality of holes 2*c*, into which the pins P2 are not inserted, so as to fasten the laminated moving member 2.

Moreover, in the pins P1 and P2 that are press-fitted into the fixed yoke 1 and the moving member 2 in their laminating directions, respectively, as shown in FIG. 4*c*, the length L of each of the pins P1 and P2 is made such that the length L is shorter than H and longer than a length in which 2T is subtracted from H, that is, $H-2T<L<H$, with respect to a lamination thickness H determined by the sheet thickness T of laminated magnetic steel sheets of the fixed yoke and the moving member and the number of laminated sheets n; therefore, the pins P1 and P2 do not project from both end surfaces of the laminated fixed yoke 1 and the laminated moving member 2 but are located at positions almost equally recessed from both end surfaces of the laminated fixed yoke 1 and the laminated moving member 2.

As described above, the electromagnetic operating device for a switch according to Embodiment 2 of the present invention is configured as follows: a plurality of holes that penetrate magnetic steel sheets in their laminating direction is provided in the fixed yoke or both fixed yoke and moving member; pins whose diameter is slightly larger than that of the plurality of holes and that have a diametrical elasticity are press-fitted into at least two of the plurality of holes to penetrate therethrough; volts are inserted into the other holes; and laminated magnetic steel sheets of the fixed yoke and the moving member are fastened using nuts. Therefore, the same effects as those in Embodiment 1 can be brought about.

In addition, according to Embodiment 2, by bringing the length L of the press-fitting pins' portions whose diameter is slightly larger than the through-holes into the relation of $H-2T<L<H$, misalignment of the laminated magnetic steel sheets can be curbed without fail, as well as no outward protrusion from laminated portions occurs; particularly in the moving member, elimination of outward protrusion from the moving member enables misalignment of the magnetic steel sheets to be prevented in portions along which the fixed yoke slides; furthermore, there is no restriction in locating misalignment-prevention pins, so that pins can be located wherever maximum effects can be achieved in preventing misalignment.

INDUSTRIAL APPLICABILITY

The present invention can be applied to an electromagnetic operating breaker and a switch gear equipped with the electromagnetic operating breaker that are used in facilities for transmission distribution, reception and the like of electric power.

DESCRIPTION OF THE REFERENCE NUMERALS

Figure 1:
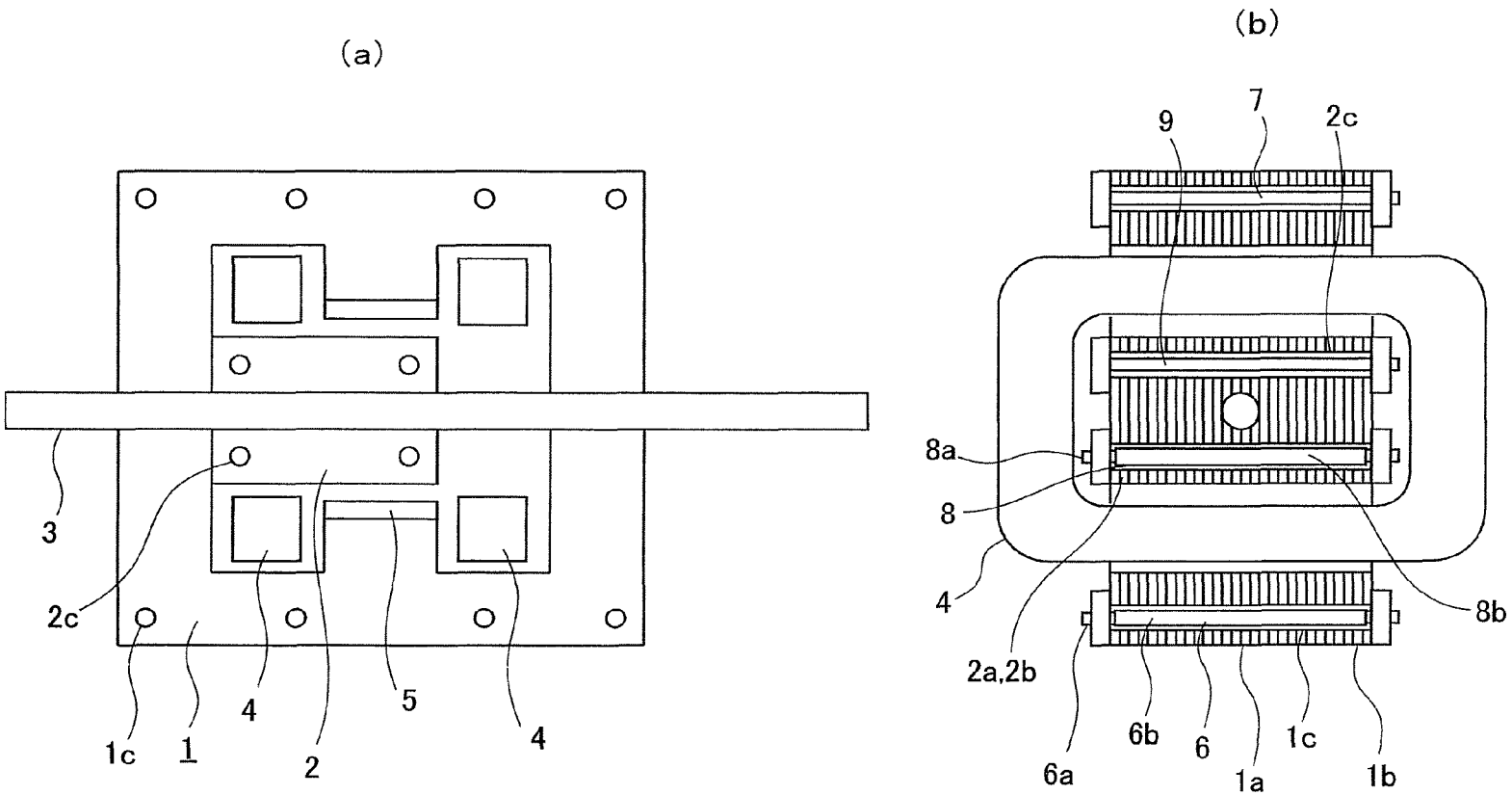
FIG. 1 is a conceptual view showing a configuration of an electromagnetic operating device for a switch according to Embodiment 1 of the present invention.
Figure 1:
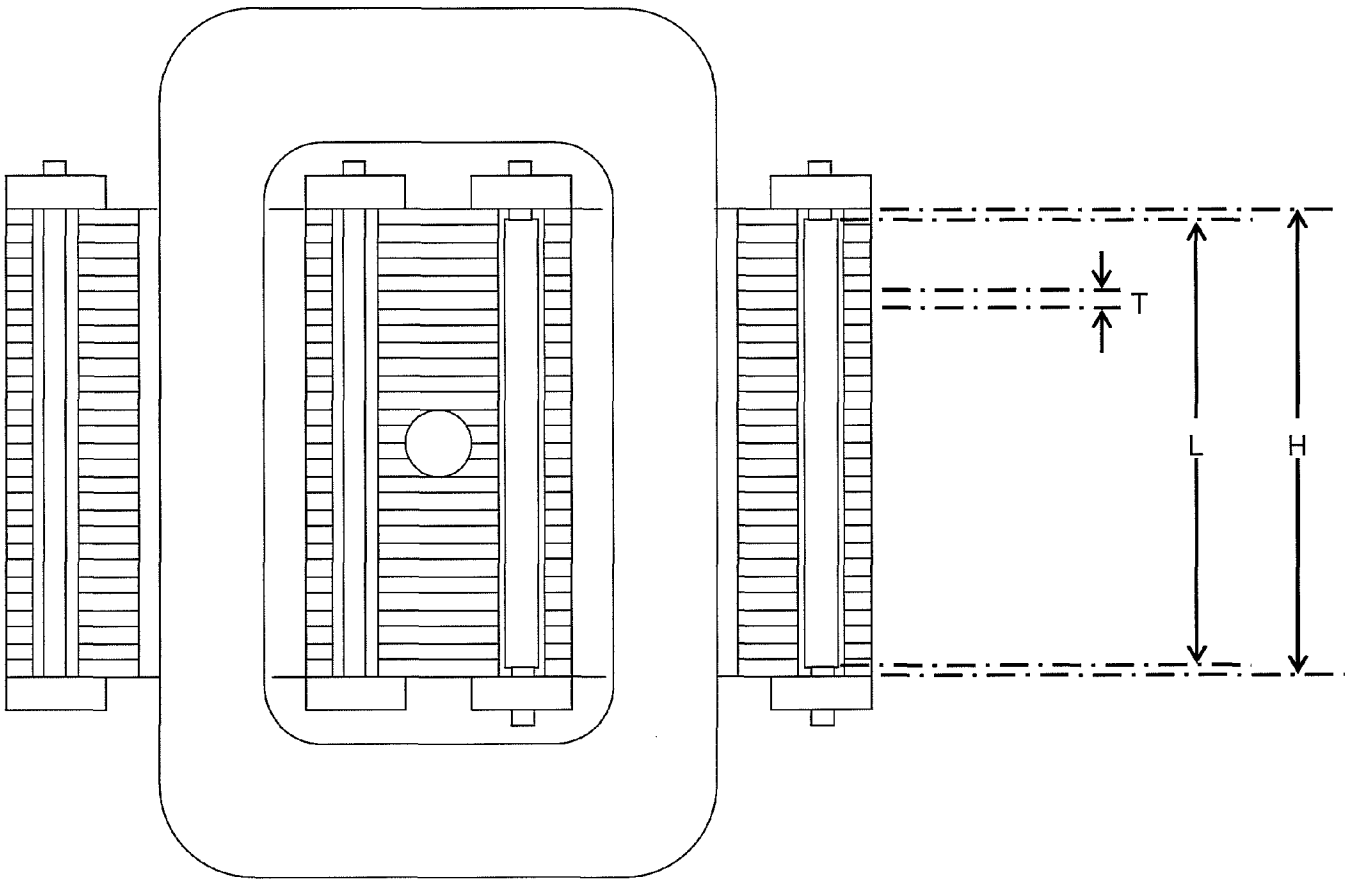
Figure 2:
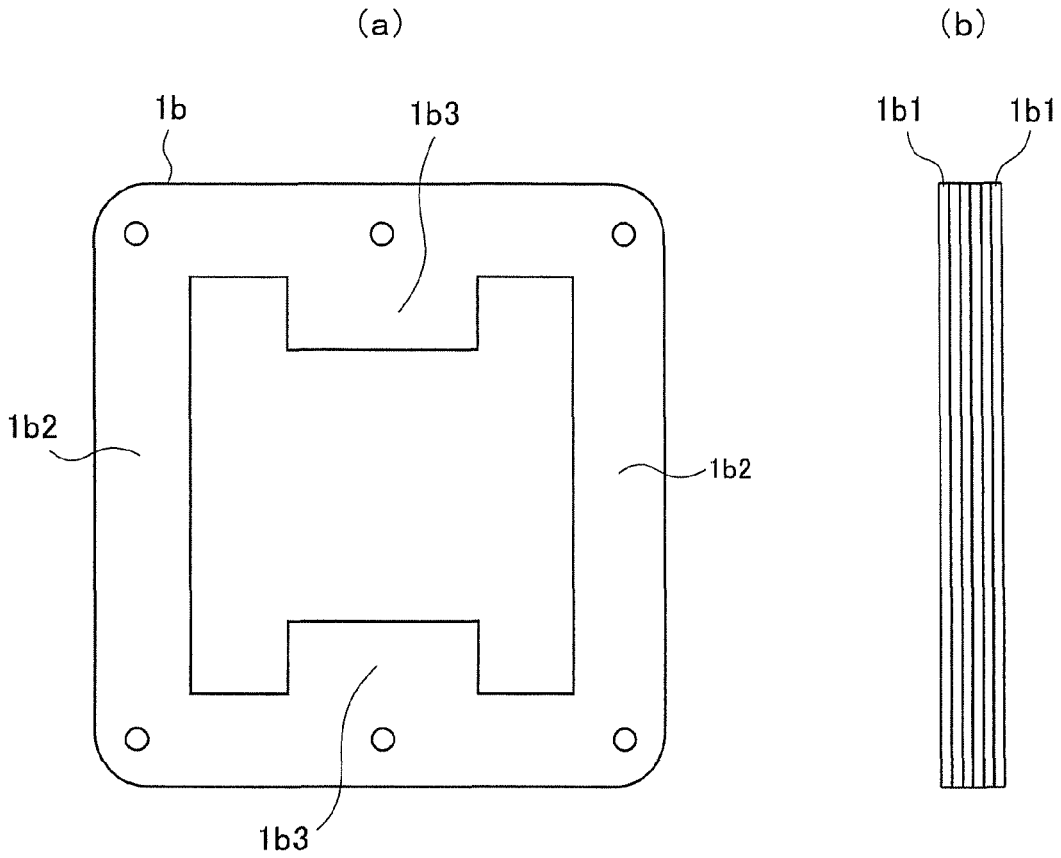
FIG. 2 is a plan view and a side view of a square yoke according to Embodiment 1 of the invention.
Figure 3:
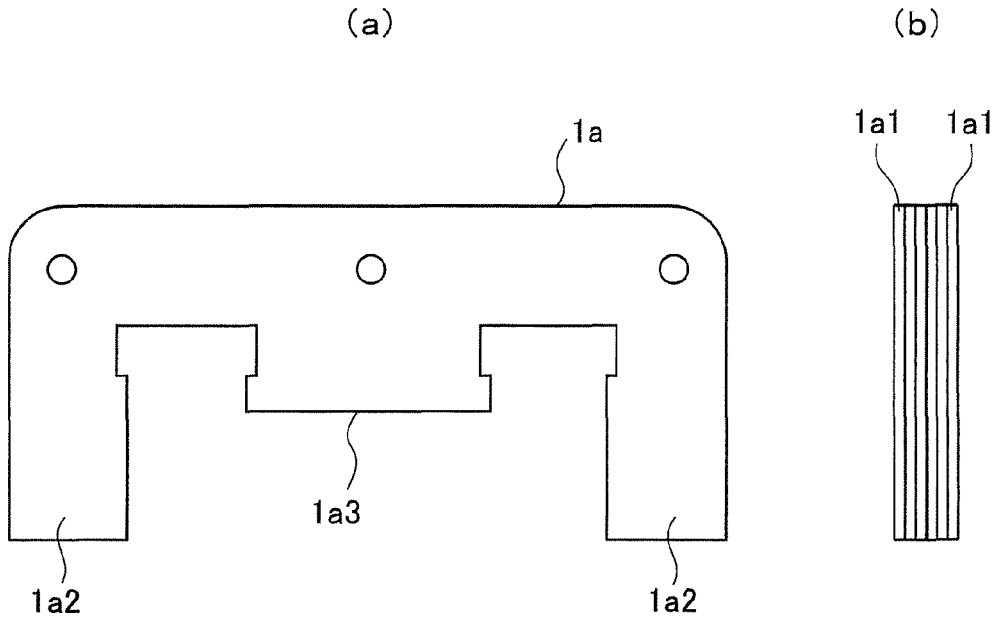
FIG. 3 is a plan view and a side view of an E-shaped yoke according to Embodiment 1 of the invention.
Figure 4:
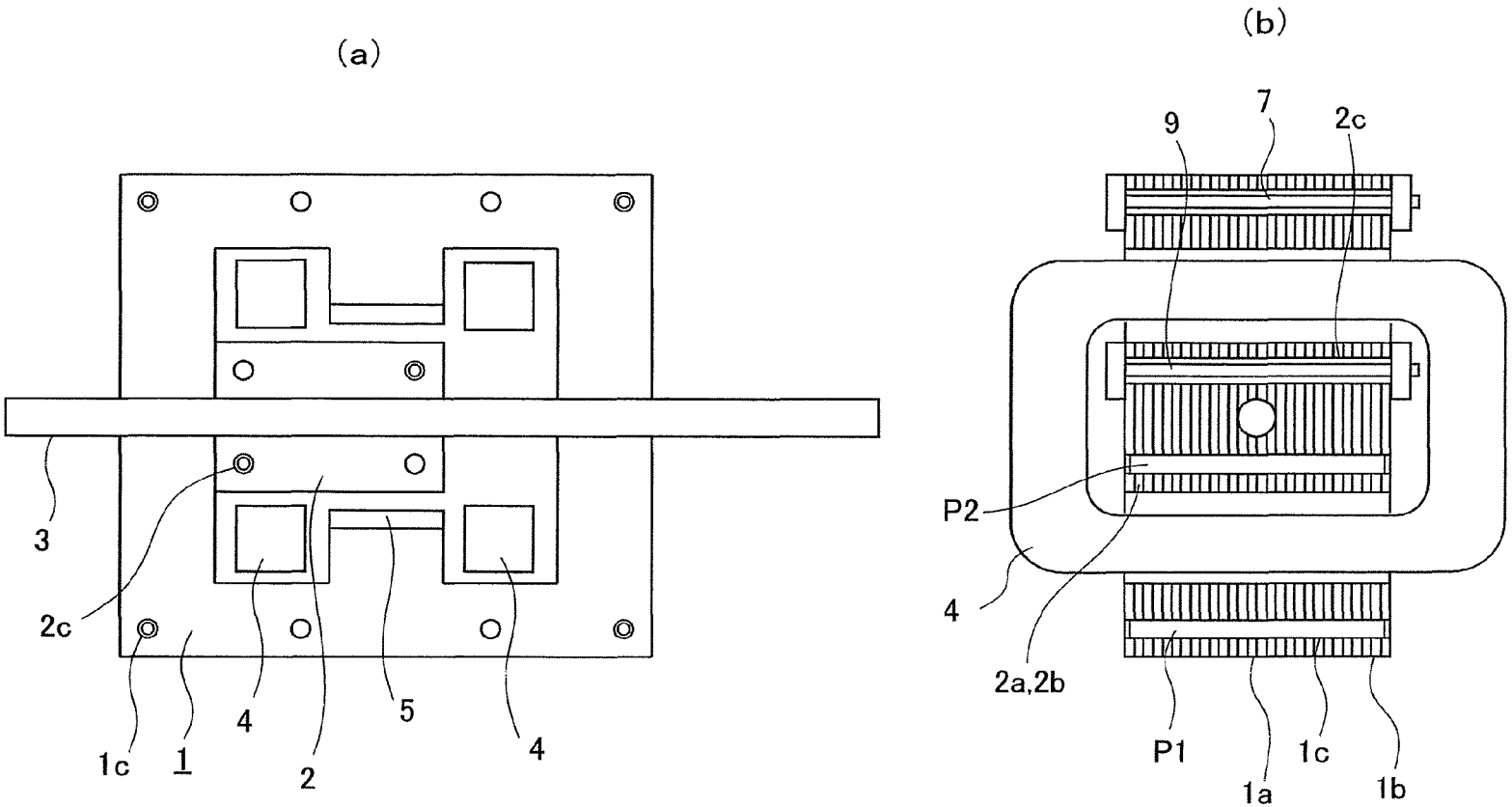
FIG. 4 is a conceptual view showing a configuration of an electromagnetic operating device for a switch according to Embodiment 2 of the invention.
Figure 4:
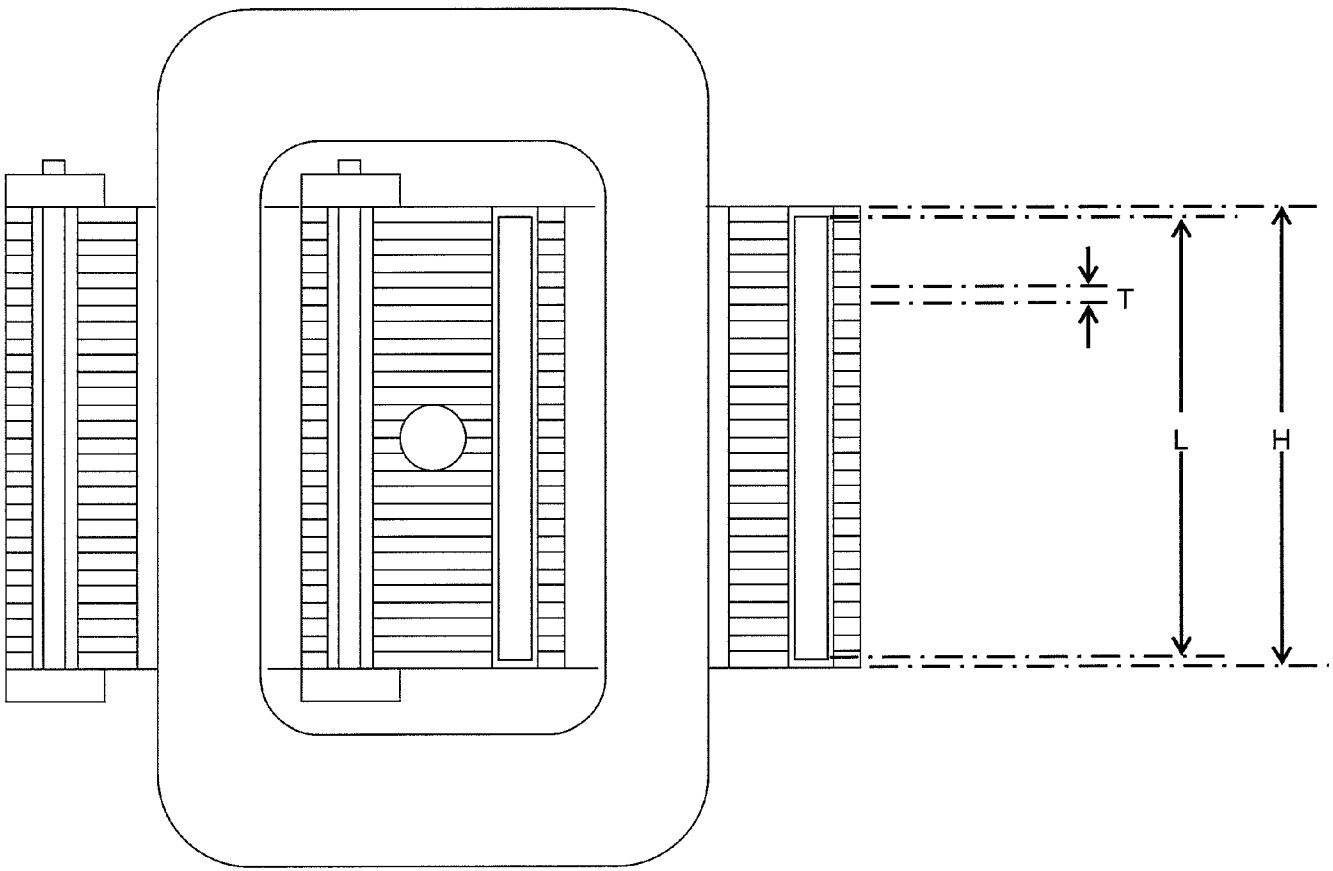
Figure 5:
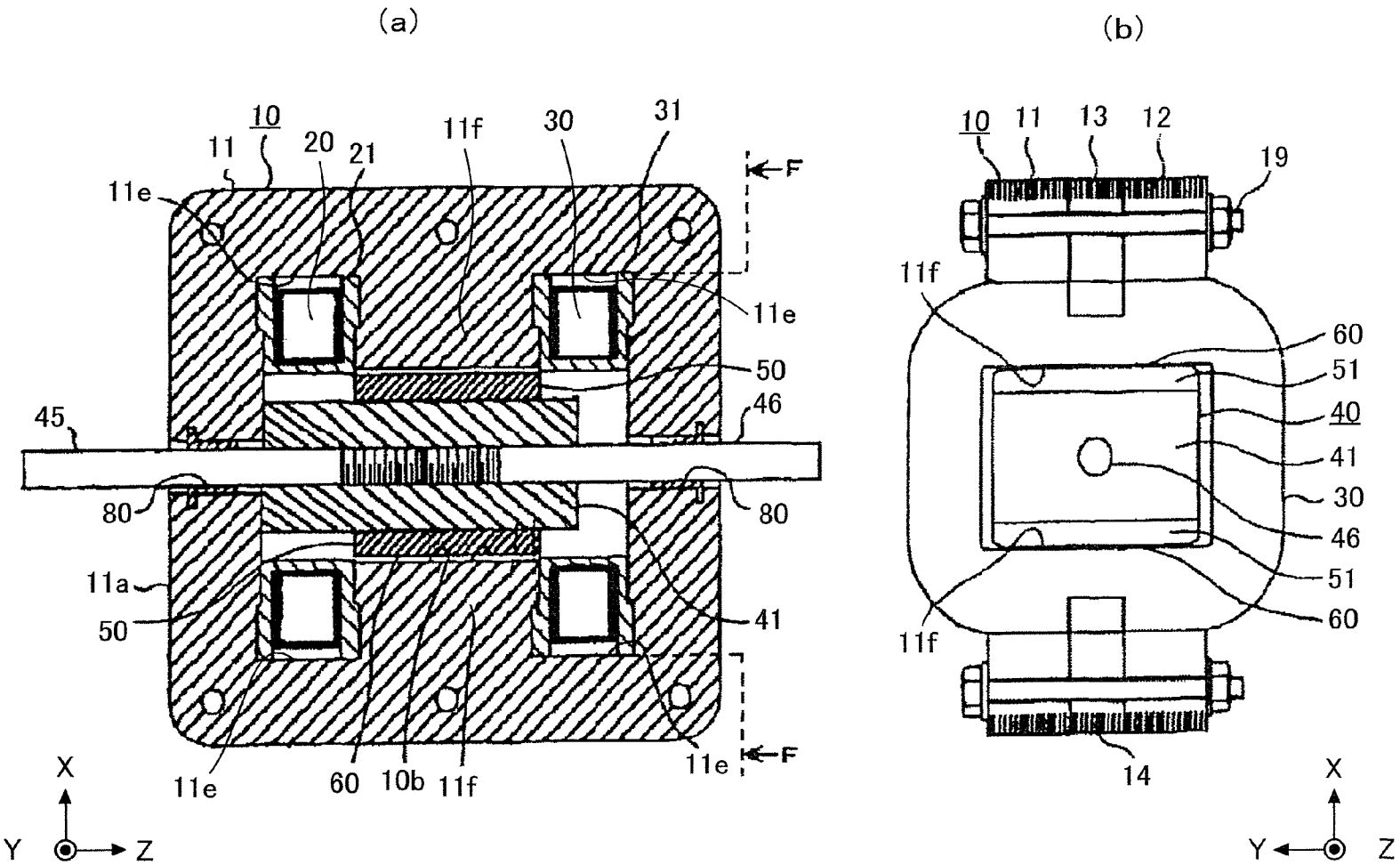
FIG. 5 is a cross-sectional view showing an example of a conventional electromagnetic operating device for a switch.

1: fixed yoke
1*a*: E-shaped yoke
1*b*: square yoke
1*c*: holes
2: moving member
2*c*: holes
3: rod
4: drive coils
5: permanent magnets
6, 8: pins
6*a*, 8*a*: threaded portions
7, 9: bolts
P1, P2: pins

The invention claimed is:

1. An electromagnetic operating device for a switch comprising:

a fixed yoke formed in such a way that E-shaped yokes formed by laminating E-shaped magnetic steel sheets are arranged opposite each other with their projecting sections of the E-shape facing each other;

square yokes formed by laminating magnetic steel sheets and having a ring-shaped core section and a projecting magnetic pole section are disposed on both outer sides of the E-shaped yokes; wherein the square yokes and the E-shaped yokes are integrally laminated with the E-shaped yokes being sandwiched between the square yokes;

permanent magnets;

a moving member for linearly moving a predetermined distance inside the fixed yoke;

a rod connected to the moving member and penetrating the fixed yoke to project outward from both sides thereof; and coils disposed in the fixed yoke, wherein the moving member is moved by magnetic flux generated by supplying a current to the coils so as to abut the inner periphery of the fixed yoke, and the movement position of the moving member being held by the magnets, and a plurality of first through-holes that penetrate the magnetic steel sheets in a laminating direction of the sheets is provided in the fixed yoke, and first pins, whose diameter is smaller than that of the plurality of first-through-holes, and have end portions that are threaded and between the end portions, a middle portion that is not threaded, are inserted into at least two of the plurality of first through-holes to penetrate therethrough, so that the laminated steel sheets of the fixed yoke are fastened using the threaded portions of the first pins and the middle portion of the first pins being recessed from an exterior surface of the magnetic steel sheets in the laminating direction.

2. An electromagnetic operating device for a switch according to claim 1, wherein the moving member is formed by laminating magnetic steel sheets, a plurality of second through-holes that penetrate the laminated magnetic steel sheets of the moving member in a laminating direction of the sheets is provided in the moving member, and second pins, whose diameter is smaller than that of the plurality of second through-holes and whose end portions are threaded and between the end portions, a middle portion that is not threaded, are inserted into at least two of the plurality of second through-holes to penetrate therethrough, so that the laminated steel sheets of the moving member are fastened using the threaded portions of the second pins.

3. An electromagnetic operating device for a switch according to claim 2, wherein the pins to be inserted into the plurality of through-holes provided in a laminating direction of the fixed yoke or both the fixed yoke and the moving member are made such that a length L of middle portions of the pins is brought into a relation of $H>L>H-2T$, with respect to a lamination thickness H determined by the sheet thickness T of laminated magnetic steel sheets of the fixed yoke and the moving member and the number of laminated sheets n.

4. An electromagnetic operating device for a switch according to claim 1, wherein the moving member is formed by laminating magnetic steel sheets, a plurality of second through-holes that penetrate the laminated magnetic steel sheets of the moving member in a laminating direction of the sheets is provided in the moving member, second pins that are larger than the plurality of second through-holes and have a diametrical elasticity are press-fitted into at least two of the plurality of second through-holes, and bolts are inserted into the other second through-holes, so that the laminated steel sheets of the moving member are fastened by nuts.

5. An electromagnetic operating device for a switch according to claim 4, wherein the second pins to be inserted into a plurality of second through-holes provided in a laminating direction of the moving member are made such that a length L of portions of the pins having a diameter that is larger than that of the second through-holes is brought into a relation of $H>L>H-2T$, with respect to a lamination thickness H determined by the sheet thickness T of laminated magnetic steel sheets of the moving member and the number of laminated sheets n.

6. An electromagnetic operating device for a switch, comprising:

a fixed yoke formed in such a way that E-shaped yokes formed by laminating E-shaped magnetic steel sheets are arranged opposite each other with their projecting sections of the E-shape facing each other;

square yokes formed by laminating magnetic steel sheets and having a ring-shaped core section and a projecting magnetic pole section are disposed on both outer sides of the E-shaped yokes wherein the square yokes and the E-shaped yokes are integrally laminated with the E-shaped yokes being sandwiched between the square yokes;

permanent magnets;

a moving member for linearly moving a predetermined distance inside the fixed yoke;

a rod connected to the moving member and penetrating the fixed yoke to project outward from both sides thereof; and coils disposed in the fixed yoke, wherein the moving member is moved by magnetic flux generated by supplying a current to the coils so as to abut the inner periphery of the fixed yoke, and the movement position of the moving member being held by the magnets, and a plurality of first through-holes that penetrate magnetic steel sheets in a laminating direction of the sheets is provided in the fixed yoke, first pins that are larger than the plurality of first through-holes and have a diametrical elasticity are press-fitted into at least two of the plurality of first through-holes to penetrate therethrough, end portions of the first pins being recessed from an exterior surface at the magnetic steel sheets in the laminating direction and bolts are inserted into the other first through-holes, so that the laminated steel sheets of the fixed yoke are fastened using nuts.

7. An electromagnetic operating device for a switch according to claim 6, wherein the moving member is formed by laminating magnetic steel sheets, a plurality of second through-holes that penetrate the laminated magnetic steel sheets of the moving member in a laminating direction of the sheets is provided in the moving member, and second pins, whose diameter is smaller than that of the plurality of second through-holes and whose end portions are threaded and between the end portions, a middle portion that is not threaded, are inserted into at least two of the plurality of second through-holes to penetrate therethrough, so that the laminated steel sheets of the moving member are fastened using the threaded portions of the second pins.

8. An electromagnetic operating device for a switch according to claim 7, wherein the second pins to be inserted into a plurality of second through-holes provided in a laminating direction of the moving member are made such that the length L of middle portions of the pins is brought into a relation of $H>L>H-2T$, with respect to a lamination thickness H determined by the sheet thickness T of laminated magnetic steel sheets of the moving member and the number of laminated sheets n.

9. An electromagnetic operating device for a switch according to claim 6, wherein the moving member is formed by laminating magnetic steel sheets, a plurality of second through-holes that penetrate the laminated magnetic steel sheets of the moving member in a laminating direction of the sheets is provided in the moving member, second pins that are larger than the plurality of second through-holes and have a diametrical elasticity are press-fitted into at least two of the plurality of holes, and bolts are inserted into the other second through-holes, so that the laminated steel sheets of the moving member are fastened by nuts.

10. An electromagnetic operating device for a switch according to claim 9, wherein the pins to be inserted into the plurality of through-holes provided in a laminating direction of the fixed yoke or both the fixed yoke and the moving member are made such that a length L of portions of the pins having a diameter that is larger than the through-holes is brought into a relation of $H>L>H-2T$, with respect to a lamination thickness H determined by the sheet thickness T of laminated magnetic steel sheets of the fixed yoke and the moving member and the number of laminated sheets n.

* * * * *